US005947534A

United States Patent [19]

Zarzycki, Jr.

[11] Patent Number: 5,947,534

[45] Date of Patent: Sep. 7, 1999

[54] PANIC EXIT DEVICE SUITABLE FOR USE WITH STANDARD DOORS

[76] Inventor: Vincent W. Zarzycki, Jr., 9098 Diplomat Pl., Philadelphia, Pa. 19115

[21] Appl. No.: 08/787,240

[22] Filed: Jan. 22, 1997

Related U.S. Application Data

[63] Continuation-in-part of application No. 08/491,788, Jun. 19, 1995, abandoned.

[51] Int. Cl.[6] ..... E05C 3/14

[52] U.S. Cl. ..... 292/92; 292/170

[58] Field of Search ..... 292/92, 169, 336.3, 292/170, 21, DIG. 57; 70/92

[56] References Cited

U.S. PATENT DOCUMENTS

| | | | |
|---|---|---|---|
| 927,654 | 7/1909 | Hood | 292/92 |
| 1,039,734 | 10/1912 | Hannum et al. | 292/21 |
| 1,256,992 | 2/1918 | Edgar et al. | 292/DIG. 57 |
| 1,408,629 | 3/1922 | Palmer | 292/DIG. 57 |
| 1,756,667 | 4/1930 | Soemer | 292/21 |
| 1,844,767 | 2/1932 | Kelly | 292/92 |
| 2,240,400 | 4/1941 | Johnson | 292/2 |
| 3,432,631 | 3/1969 | Deutscher et al. | 292/92 |
| 3,464,728 | 9/1969 | Ruckel et al. | 292/92 |
| 3,490,803 | 1/1970 | Rollins | 292/170 |
| 3,765,198 | 10/1973 | Horgan, Jr. | 70/92 |
| 4,101,153 | 7/1978 | Dozier | 292/92 |
| 4,145,900 | 3/1979 | Ohno | 292/92 |
| 4,167,280 | 9/1979 | Godec et al. | 292/92 |
| 4,295,673 | 10/1981 | Miller | 292/336.3 |
| 4,470,278 | 9/1984 | Hale et al. . | |
| 4,470,279 | 9/1984 | Neary et al. . | |

(List continued on next page.)

OTHER PUBLICATIONS

Parts Sheet for Knobs & Roses (1 sheet).

Parts Sheet for Standard and Optional Trims (1 sheet).

Parts Sheet for 99 Mortise Lock Device (1 sheet).

Parts Sheet for "Detex Exit Control Lock Battery–Powered Alarm and Exit Control Device" (ECL–230C) (5 sheet).

Parts Sheet for "Detex Exit Control Lock Battery–Powered Alarm and Exit Control Device" (ECL–2200) (1 sheet).

Corbin "Exit Devices," Section i, Rev. Jan. 30, 1987 (Brochure).

Corbin "Futurabar™ Exit Devices," Section $i_2$, Rev. Jul. 1991 (Brochure).

Mohawk Flush Doors, Inc. "The Doors of Mohawk" (Brochure).

Von Duprin® "Touchbar/Crossbar Exit Devices" 08716/VON Buy Line 0724 (Brochure).

Arrow™ "Architectural Hardware" 08710/ARS Buy Line 4501 (ASW–1992) (Brochure).

Pioneer "Standard and Featured Steel Doors and Frames" (Brochure).

Corbin Russwin™ "Architectural Hardware" Product Guide (1993) (Brochure).

Monarch Hardward & Manufacturing, "19 Series", (1995) Brochure.

Parts Sheet for 6 Line Latch Assemblies (1 sheet).

*Primary Examiner*—Darnell M. Boucher

*Attorney, Agent, or Firm*—Woodcock Washburn Kurtz Mackiewicz & Norris LLP

[57] ABSTRACT

A panic device that can be easily installed and used with standard doors and door jambs manufactured or prepared for conventional latching mechanisms is disclosed. The disclosed panic device can be used to replace a door knob without replacing or significantly altering the door or door frame. The latching mechanism of the panic device is housed in the hollow sections of a standard door and door jamb, e.g., in sections formerly occupied by a knob and its associated latching mechanism. The panic device includes a panic bar apparatus mounted on the exterior of the door and a latch compressing mechanism occupying the hollow section of the door. The panic bar apparatus and latch compressing mechanism interact with one another to control the movement of a latch bolt inside the door, i.e., the same latch bolt as that employed in the conventional two-knob arrangement. The latch compressing mechanism may also be controlled by a standard door knob or handle mounted on the side of the door opposite the panic bar.

7 Claims, 12 Drawing Sheets

U.S. PATENT DOCUMENTS

| | | | |
|---|---|---|---|
| 4,747,629 | 5/1988 | Miller | 292/92 |
| 4,865,367 | 9/1989 | Choi | 292/92 |
| 4,895,399 | 1/1990 | Horgan, Jr. | 292/92 |
| 4,927,193 | 5/1990 | Miller | 292/92 |
| 4,968,070 | 11/1990 | Choi | 70/92 |
| 4,976,476 | 12/1990 | Cross et al. | 292/21 |
| 5,031,945 | 7/1991 | Toledo | 292/92 |
| 5,042,851 | 8/1991 | Hunt | 292/21 |
| 5,169,185 | 12/1992 | Slaybaugh et al. | 292/92 |

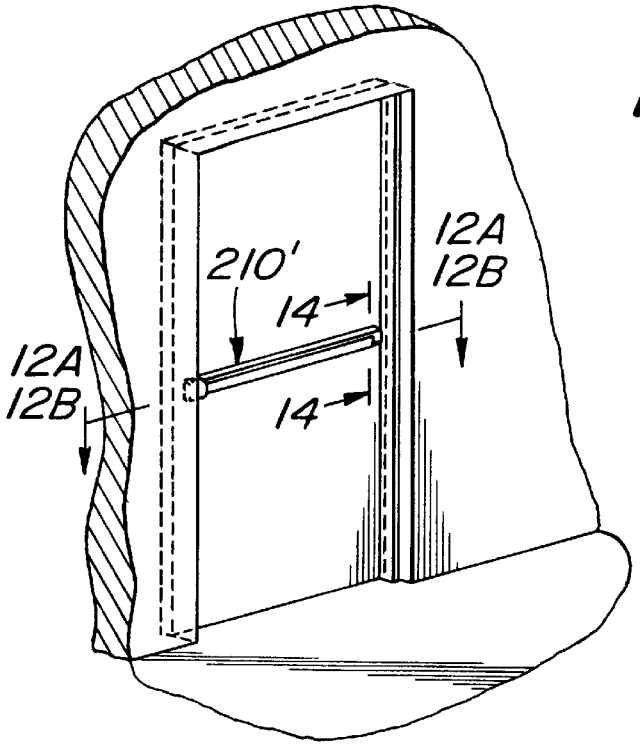
FIG. 11
FIG. 14
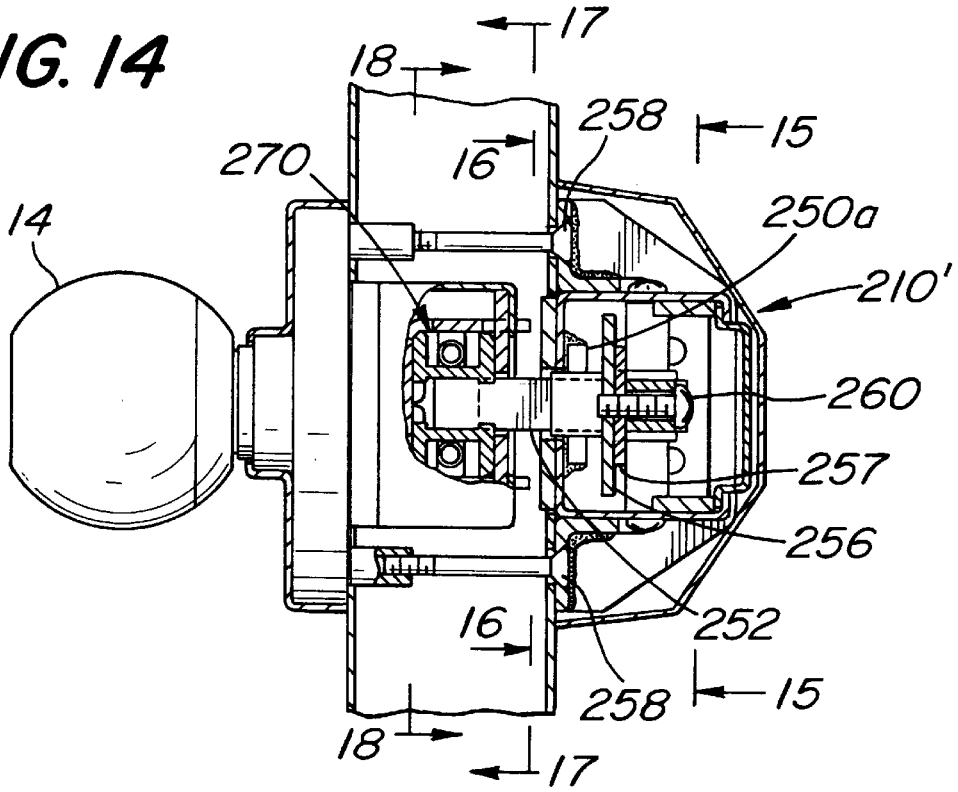

PANIC EXIT DEVICE SUITABLE FOR USE WITH STANDARD DOORS

CROSS REFERENCE TO RELATED APPLICATION

This is a continuation-in-part of U.S. patent application Ser. No. 08/491,788, filed Jun. 19, 1995 now abandoned.

FIELD OF THE INVENTION

The present invention relates generally to a panic exit device, and more particularly to a panic exit device that may be used with a door having standard 161 cutouts and fitted for a knob or handle latching mechanism.

BACKGROUND OF THE INVENTION

A panic exit device (or panic device) operates by employing an inward force on a push bar to unlatch a latching mechanism from a latch strike. Panic devices commonly incorporate a latching mechanism mounted on the exterior of a door and a latch strike mounted on the exterior of a door jamb.

FIGS. 1 and 2 depict a "standard" door 10 (i.e., a door having standard 161 circular cut outs for receiving a door knob lock set and not adapted for a mortise lockset, which requires a rectangular cutout in the door trim) employing an internal latching mechanism. FIG. 1 shows the "the door" 10 with knobs 14 located on both sides. Turning either knob 14 will release a latch bolt 16 (FIG. 2) from the door jamb 22 and allow the door 10 to open.

FIG. 2 is a sectional view of the door and knobs of FIG. 1 as seen from plane line 2—2. As shown, the latching mechanism comprises the latch bolt 16, latch bolt tumbler 20, latch control arm 232 and latch control assembly 236. The latching mechanism is predominately located within a noticed portion of the door. The latch bolt 16 extends into a notched section of the door jamb 22 when the door is closed and latched. A deadlocking plunger (not shown) presses against the latch bolt strike 18 and remains substantially within the latch bolt tumbler 20 when the door is in a closed position. Turning either knob 14 causes the latch control assembly 236 to exert a pulling force on the latch control arm 232. This pulling force on the latch control arm 232 draws the latch bolt 16 and deadlocking plunger away from the door jamb 22 and into the latch bolt tumbler 20. With the latch bolt 16 and deadlocking plunger removed into the latch bolt tumbler 20, the door is free to move over the latch bolt strike 18 and swing open.

FIGS. 3 and 4 depict a prior art ("rim" type) panic device. FIG. 3 is a view, partially in section, illustrating the panic device mounted on a door 140. The latching mechanism (comprising a push rail 120, rail assembly 121, latch bolt linkage member 122, latch bolt 124 and latch bolt assembly cover 130) of the panic device is exterior to the door 140. The latch strike 126 is similarly mounted on the exterior of the door jamb 134. When the push rail 120 is pressed toward the door, the resulting movement of the latch bolt linkage member 122 causes the latch bolt 124 to unlatch from the latch bolt strike 126. This permits the door 140 to swing away from the door jamb 134.

FIG. 4 depicts a view from the perspective of one facing the push bar 120. The relative location of the door knob 128 located on the opposite side of the door is depicted with dashed lines. As illustrated, the push bar and the door knob have different vertical alignments, and both the latch bolt 124 and latch strike 126 are visible because they are mounted exteriorly to the door. The door knob 128 is mounted below the push bar 120 so that the door knob is aligned and can be interfaced with a receptacle in the latching mechanism contained in the latch bolt assembly cover 130. This interface between the door knob 128 and the latching mechanism internal to the latch bolt assembly cover 130 allows the latching and unlatching of the latch bolt to be controlled by turning the door knob.

Panic devices of the kind described above typically may be used only with doors and door frames which are specially manufactured or altered for use with a panic device. As discussed above, a door that has been prepared with cutouts generally has a hollow section in which the latching mechanism and door knob are mounted, and a standard door jamb similarly has a hollow section in which a latch strike is mounted. The hollow section and exterior cutouts on a door prepared for a standard two-knob assembly are larger and located at a different vertical height than the hollow section and exterior cutouts on doors prepared for receiving a panic device. The exterior cutouts and the hollow section of a standard two-knob door occupy areas to which fastening screws would be anchored if a conventional panic device were mounted to the door. The location of the exterior cutouts and the size of the hollow area of a standard door preclude a conventional panic device from being securely mounted to a standard two-knob door at the appropriate height. Furthermore, the hollow area of a door jamb is superfluous when an exterior mounted latch strike is mounted to the door frame. This incompatibility between panic devices and "161 doors" and door jambs makes the conversion between conventional latching mechanisms and panic devices an expensive task. When a conventional latching mechanism is replaced with a panic device, it is necessary to replace the entire door and refit the door jamb with a new latch bolt strike. Similarly, when a panic device is replaced with a standard, non-panic latching mechanism, it is necessary to replace the entire door and refit the door jam with a new door strike. Therefore, consumers who convert from a standard knob or handle arrangement of a "161 door" to a panic device, or vice versa, are forced to expend large amounts of time, labor, and money in the conversion. Furthermore, retailers of doors and door finishing parts must keep an inventory of very similar but incompatible stock.

SUMMARY OF THE INVENTION

Accordingly, an object of the present invention is to provide a panic device that can be quickly and inexpensively mounted to a door that has previously been prepared with cutouts (e.g., standard 161 cutouts) for two knobs as described above. Another object of the invention is to provide a panic device that is operable with less than about 50 pounds of force applied to the panic bar.

The present invention provides a panic device that may be employed with a standard "161 door" and door frame, so that a consumer can replace a door knob or handle with a panic device , or vice versa, without replacing or significantly altering the door or door frame. Therefore, the invention provides a means for obtaining substantial savings in time, labor and materials cost. The present invention is especially suited for doors of the type which previously required the use of a "rim" type panic device, if any, since these doors are not suited for a mortise or vertical rod type panic device. As used herein, the expressions "standard door" and "161 door" refer to a non-mortise type door having the cutouts suited for a two-knob lockset of the type described above.

In presently preferred embodiments of the invention, the latch control mechanism of an existing lockset is utilized, as are an existing knob, latch bolt, tumbler, and strike. Such embodiments include a panic bar mounted on the exterior of the door and a latch compression mechanism occupying the hollow section of the door. The panic bar apparatus and latch compression mechanism interact with one another to control the movement of the latch bolt inside the door, i.e., the same latch bolt as that employed in the conventional two-knob arrangement depicted in FIGS. 1 and 2.

Two exemplary embodiments of the present invention are described below. The first embodiment is described with reference to and depicted in FIGS. 5–10. The second embodiment is an improvement of the first, and is depicted in FIGS. 11–19. The second embodiment is preferred and has the advantage of requiring less force to be exerted on the panic bar in order to open the door.

The present invention therefore provides a panic device which can be easily installed and used with doors and door jambs which have been manufactured or prepared for conventional locking and latching mechanisms. The panic device strike plate can be installed on new or used wood or hollow metal doors and jambs, including those with 161 cylindrical lock preparations. All, or at least most, hollow metal doors are reinforced for 161 cylindrical lock preparations. In contrast to the prior art, the inventive panic device can be used with the conventional strike in existing frames, and no reinforcement of hollow metal doors is required. The invention may also be used with pairs of doors. Other features of the present invention are described below.

BRIEF DESCRIPTION OF THE DRAWINGS

FIG. 5 is a perspective view of a standard door 10 with a panic device 210 in accordance with the first embodiment of the present invention mounted on one side and a knob on the other.

FIG. 6 is a sectional view of the door, panic device, and knob depicted in FIG. 5 as seen along line 6—6.

FIG. 7 is a sectional view of the door, panic device, and knob depicted in FIG. 5 as seen along line 7—7.

FIG. 8 is an enlarged front view of the inventive panic device.

FIG. 9 is a sectional view of the inventive door, panic device, and knob, showing further details of the panic device.

FIG. 10 is an exploded view of the manner in which the inventive panic device is coupled to a door knob inside a standard door.

FIGS. 11–19 depict a second, preferred embodiment of the invention.

FIG. 11 is similar to FIG. 5, i.e., it is a perspective view of a standard door with a panic device 210' in accordance the second embodiment of the invention.

FIG. 13 is a sectional view of the panic device, showing a locking mechanism, as seen along line 13—13 of FIG. 12B.

FIG. 14 is a sectional view of the door, panic device, and knob depicted in FIG. 11 as seen along line 14—14.

FIG. 15 is a sectional view of the panic device as seen along line 15—15 of FIG. 14.

FIG. 16 is a sectional view of the door and panic device as seen along line 16—16 of FIG. 14.

FIG. 17 is a sectional view of the door and internal latching mechanism looking in the direction of the knob (i.e., from the inside out) as seen along line 17—17 of FIG. 14.

FIG. 18 is a sectional view of the door and internal latching mechanism looking in the direction of the panic device (i.e., from the outside in) as seen along line 18—18 of FIG. 14.

FIG. 19 is an exploded view of the manner in which the panic device 210' is coupled to a door knob inside a standard door.

DESCRIPTION OF PREFERRED EMBODIMENTS

Figure 5:
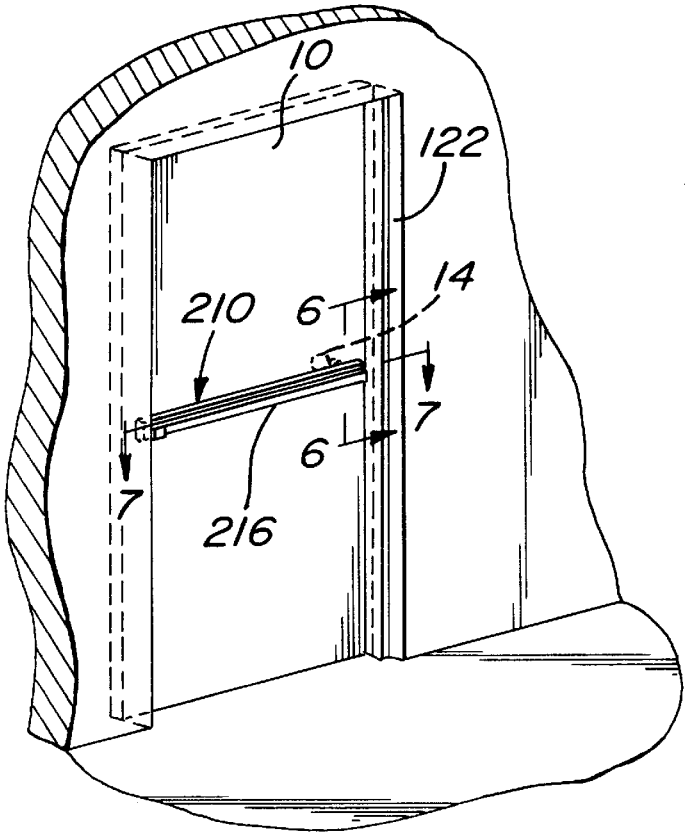
FIGS. 5–10 depict a first embodiment of the present invention.

FIGS. 5 through 10 depict the first embodiment of the invention. FIG. 5 is a perspective view of a standard, 161 door 10 with a panic device 210 in accordance with present invention mounted on one side opposite a conventional door knob 14 on the other. Turning the door knob 14 or pressing on the panic bar 216 will release the latch bolt from the door jamb 22 and withdraw the deadlocking plunger (not visible) from the latch bolt strike 18, allowing the door 10 to open.

Figure 1:
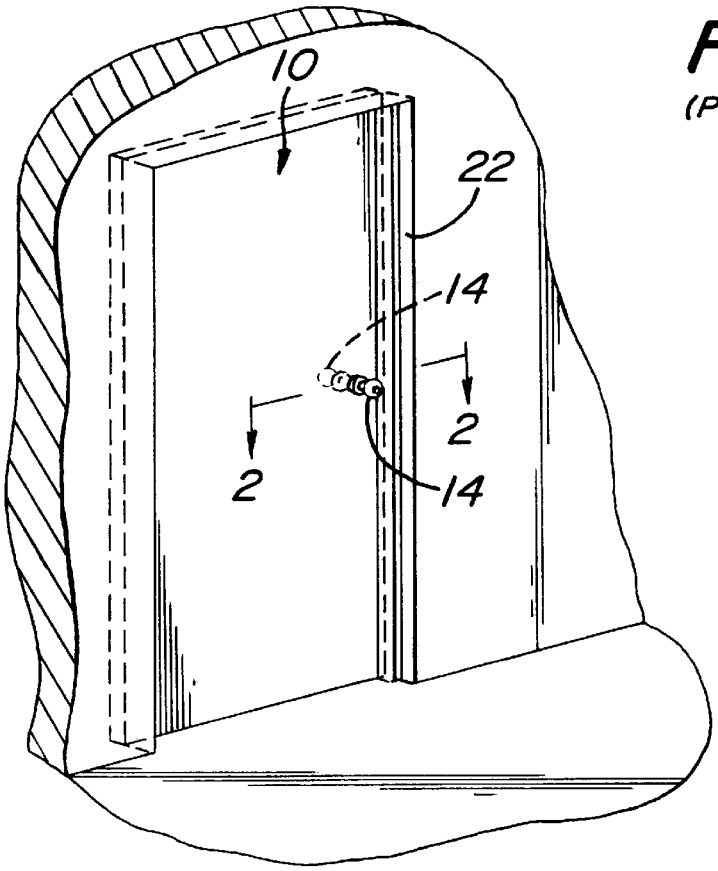
FIG. 1 (PRIOR ART)
FIG. 1 is a perspective view of a standard door 10 with conventional knobs 14 on both sides.
Figure 2:
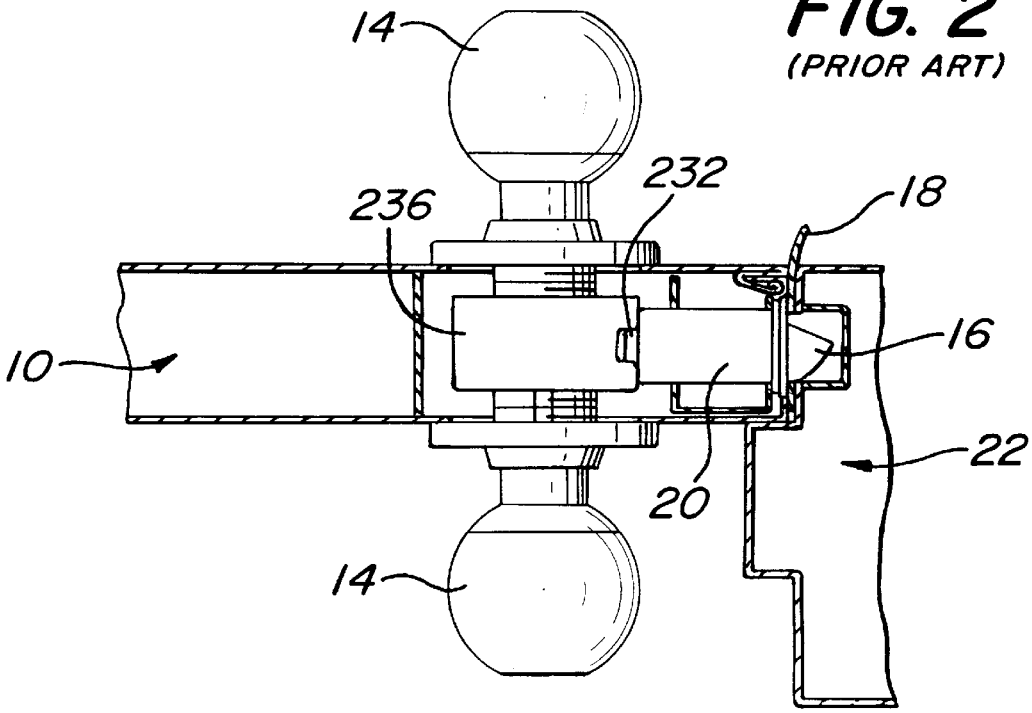
FIG. 2 (PRIOR ART)
FIG. 2 is a cross-sectional view of the door 10 and knobs 14 of FIG. 1 as seen along line 2—2 of FIG. 1.
Figure 3:
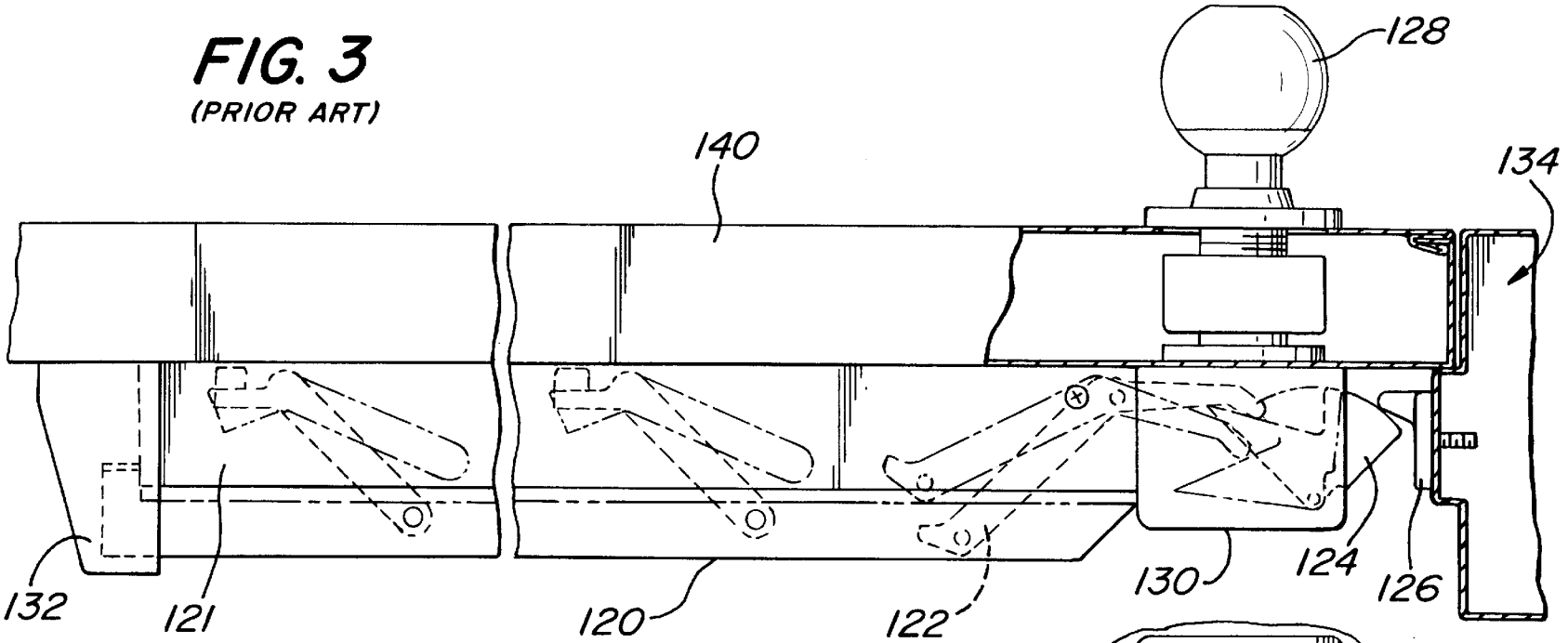
FIG. 3 (PRIOR ART)
FIG. 3 is a view, partially in section, of a prior art panic device mounted on a door 140.
Figure 6:
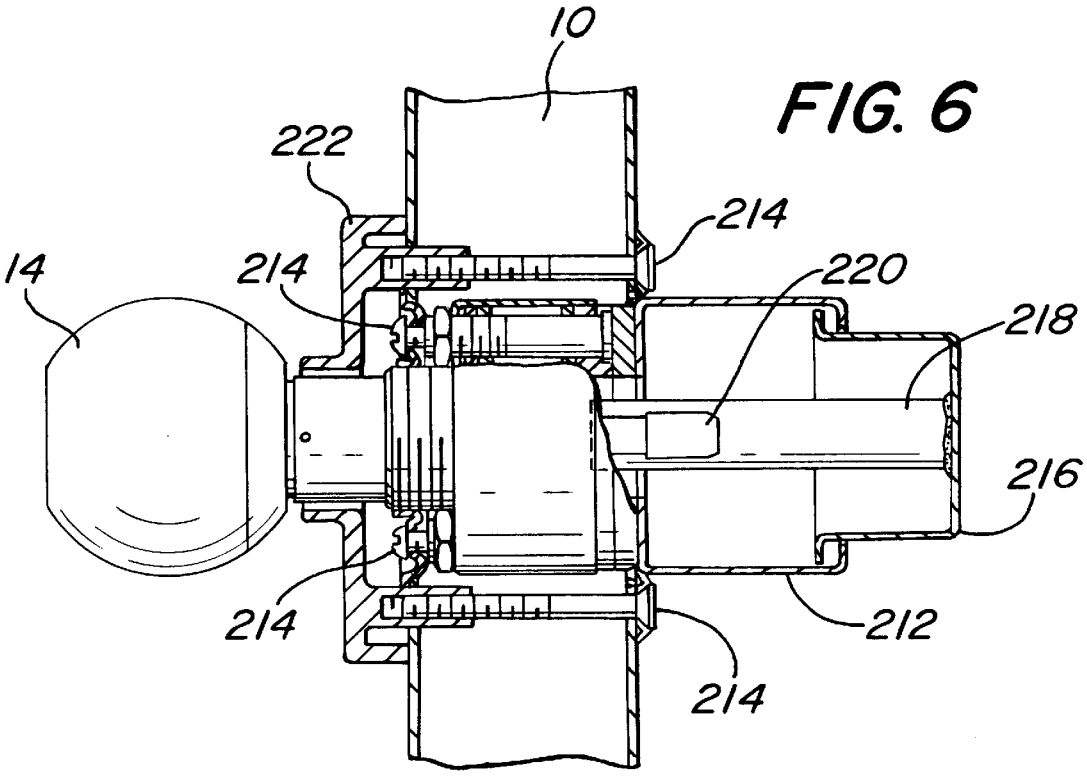

FIG. 6 illustrates the location and construction of the latching mechanism as seen in the plane 6—6. The latching mechanism of the present invention is similar to the latching mechanism of the conventional two-knob arrangement depicted in FIGS. 1 and 2 in that it is situated inside the standard door 10. This is a significant improvement over the prior art panic device arrangement depicted in FIGS. 3 and 4 in which the latching mechanism is situated exterior to the door and door jamb. Because the latching mechanism of the present invention is located in the interior of the door and may occupy the hollow space of a standard two-knob door, no alteration to the door or door jamb is required to use the invention with a standard two-knob door. This characteristic allows for quick, easy, and inexpensive conversion between a two-knob arrangement and a panic device in accordance with the invention. The latching mechanism includes the components depicted in FIGS. 6 through 10, including a rail assembly 212, screws 214, panic bar 216, panic release member 218, latch compression member 220, end cap 224, push bar linkage members 226, latch recoil spring 228, latch recoil connector 230, latch control arm 232, knob control mechanism 234, and latch control assembly cover 236. Many of these components are common to a prior art two-knob latching assembly and a prior art panic device, and so a panic device in accordance with the present invention can be made by modifying a prior art panic device and two-knob latching assembly. The first embodiment can be made by modifying the prior art devices in part by affixing the member 220 to the latch recoil connector 230 of a two-knob latching assembly. In addition, a park release member 218 is affixed to the interior of a push bar 216 where said member protrudes through a cutout in the bottom of the rail assembly 212 mounted to a door opposite the door knob 14 so that the member contacts the latch compression member 220 protruding from the latch recoil connector 230.

Figure 7:
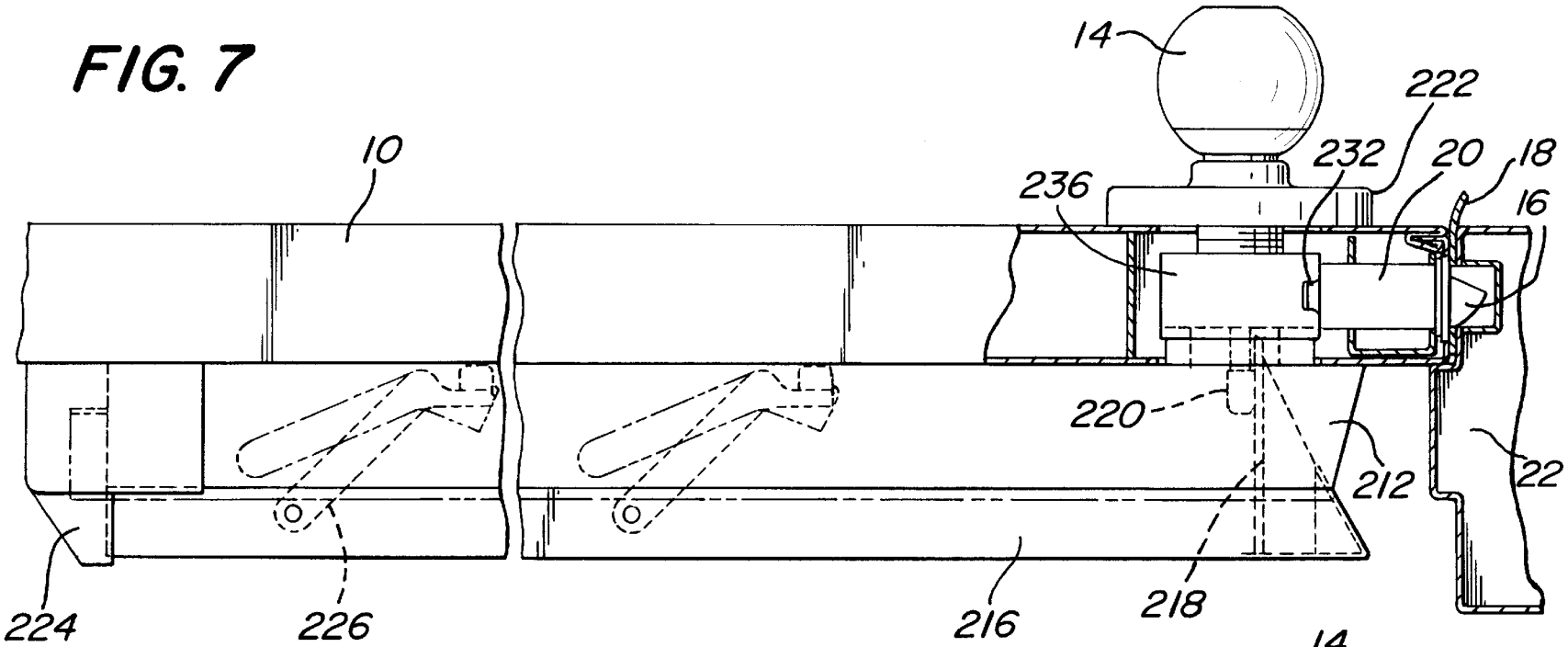

FIG. 7 is a sectional top view of the door 10, panic device 210, and door knob 14 depicting the internal mechanical components of the panic device assembly. Similar to the standard arrangement depicted in FIG. 2, the latch mechanism is located internal to the door and door jamb. Like the door assembly of FIG. 2, turning knob 14 causes the mechanism in the latch control assembly cover 236 to exert a pulling force on the latch control arm 232. This pulling force causes the latch bolt 16 and deadlocking plunger (not visible) to be drawn away from the door jamb 22 and into the latch bolt tumbler 20. With the latch bolt 16 and deadlocking plunger removed into the latch bolt tumbler 20, the door is free to move over the latch bolt strike 18 and swing open.

Pressing the panic bar 216 inward toward the door 10 has a similar effect. When the panic bar is pressed toward the door 10, it moves both inward toward the door and in the horizontal direction away from the door jamb 22. The horizontal motion causes the panic release member 218 to come into contact with and to horizontally displace the latch compression member 220. Similar to the effect of turning the knob 14, the horizontal movement of the latch compression member 220 causes the mechanism contained within the latch control assembly cover 236 to exert a pulling force on the latch control arm 232. This pulling force causes the latch bolt 16 and deadlocking plunger to be drawn away from the door jamb 22 and into the latch bolt tumbler 20. With the latch bolt 16 and deadlocking plunger removed into the latch bolt tumbler 20, the door is free to move over the latch bolt strike 18 and swing open.

Figure 4:
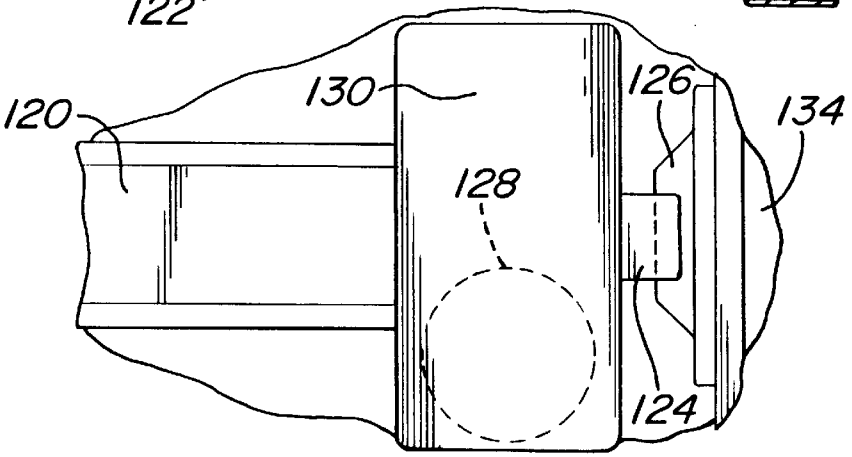
FIG. 4 (PRIOR ART)
FIG. 4 is an enlarged front view of the prior art panic device depicted in FIG. 3.
Figure 8:
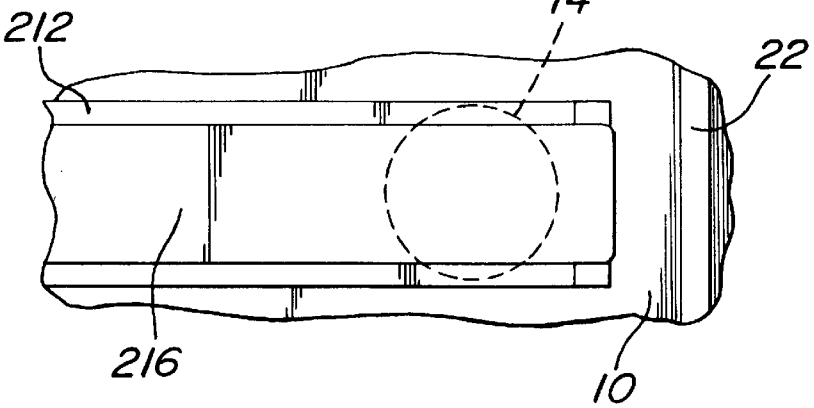

FIG. 8, highlights two significant differences between the invention and the prior art depicted in FIG. 4. FIG. 4 depicts the door from the perspective of one facing the panic bar 216 and shows the relative location of the door knob 14 located on the opposite side of the door. Unlike the prior art door knob 128 and push bar 120 shown in FIG. 4, the knob 14 and push bar 216 in FIG. 8 are aligned vertically. Furthermore, unlike the prior art, the latching mechanism of the present invention is not visible when the door is closed. As shown in FIG. 7, the latch bolt 16 is seated in the latch bolt strike 18, and both are hidden from view when the door is closed.

Figure 9:
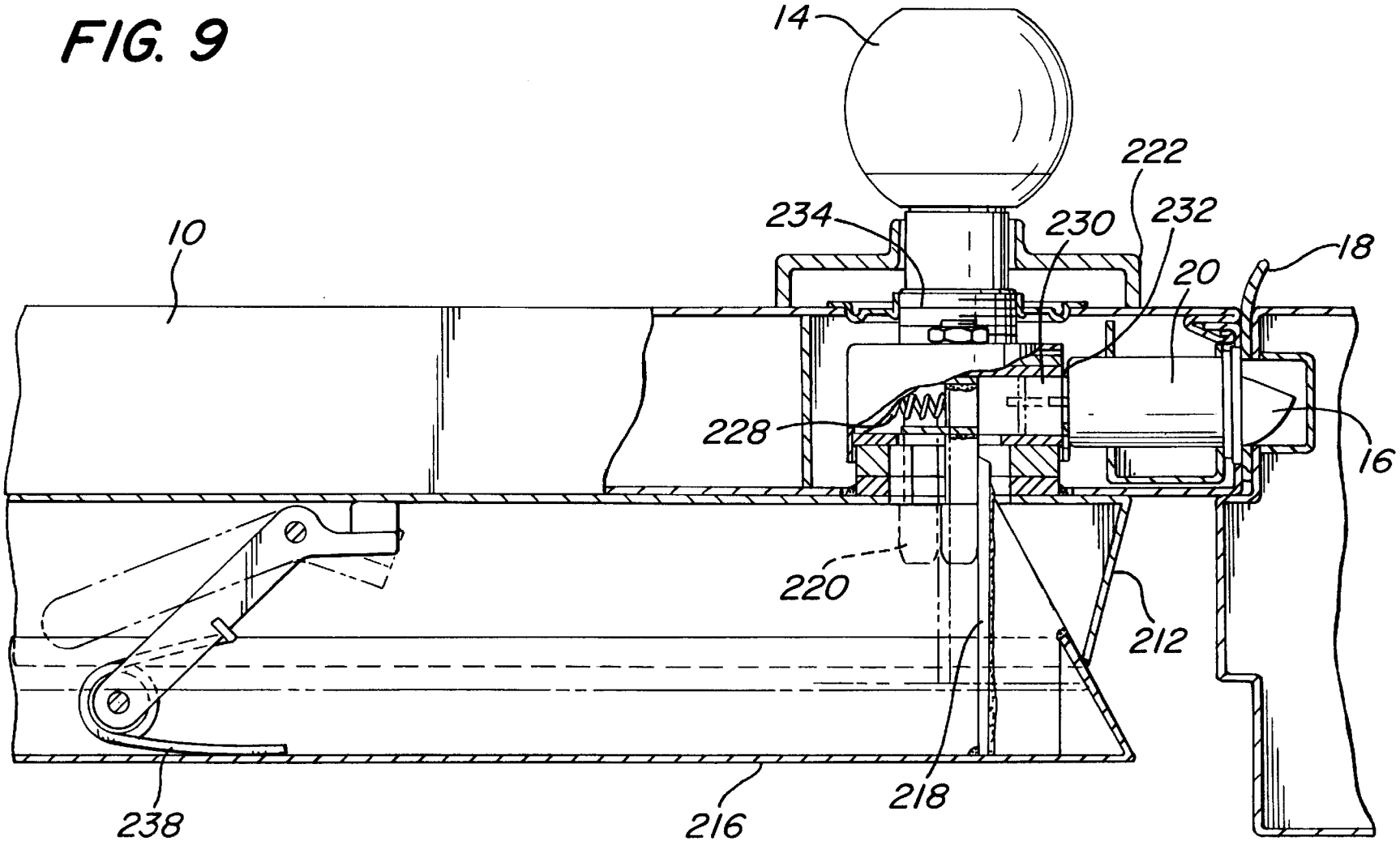

FIG. 9 provides a more detailed view of the workings of the first embodiment of the present invention. As depicted in FIG. 9, the latch compression member 220 is welded to the latch recoil connector 230. The opposite end of the latch recoil connector 230 is attached to, or grabs, the latch control arm 232. (The latch control assembly, including the recoil connector 230 and control arm 232, is part of an existing lockset, e.g., one available from Schlage Lock Company, San Francisco, Calif. Such locksets typically provide an interface whereby the knob or handle engage the latch control mechanism, which in turn engages the latch bolt, thus permitting the knob or handle to control the operation of the latch bolt. The present invention employs this existing interface but uses it to permit the panic device to operate the latch bolt.) Horizontal movements of the latch compression member 220 are transferred to the latch control arm 232 by the rigid latch recoil connector 230. FIG. 9 also shows that the latch recoil connector 230 is movably connected to the knob control mechanism 234. This relationship allows for the exertion of a horizontal force on the latch recoil connector 230 that is subsequently transferred to the latch control arm 232. The pulling force exerted on the latch control arm 232 causes the latch bolt 16 and deadlocking plunger (not visible) to be drawn away from the door jamb 22 and into the latch bolt tumbler 20. The rigid connection between the latch compression member 220 and the latch recoil connector 230 allows for horizontal forces exerted on the latch compression member 220 to have a similar effect. A horizontal force on the latch compression member 220 is transferred to the latch recoil connector 230 and acts upon the latch control arm 232 to withdraw the latch bolt 16 and deadlocking plunger away from the door jamb 22 and into the latch bolt tumbler 20. With the latch bolt 16 and deadlocking plunger removed into the latch bolt tumbler 20, the door is free to move over the latch bolt strike 18 and swing open.

FIG. 9 also depicts a latch recoil spring 228 firmly connected to the latch control assembly cover 236 on the one end and the latch recoil connector 230 on the other. The latch recoil spring 228 exerts a continuous horizontal force on the latch recoil connector 230 such that in the absence of horizontal forces applied by either the panic release member 218 or the knob control mechanism 234, the latch recoil connector 232, latch compression member 220, latch control arm 232, deadlocking plunger, and latch bolt 16 are located in their latched positions. Similarly, torsion spring 238 exerts a continuous force on the panic bar 216 such that, in the absence of pressure applied to the panic bar 216, the panic bar will be moved away from the door 14.

Figure 10:
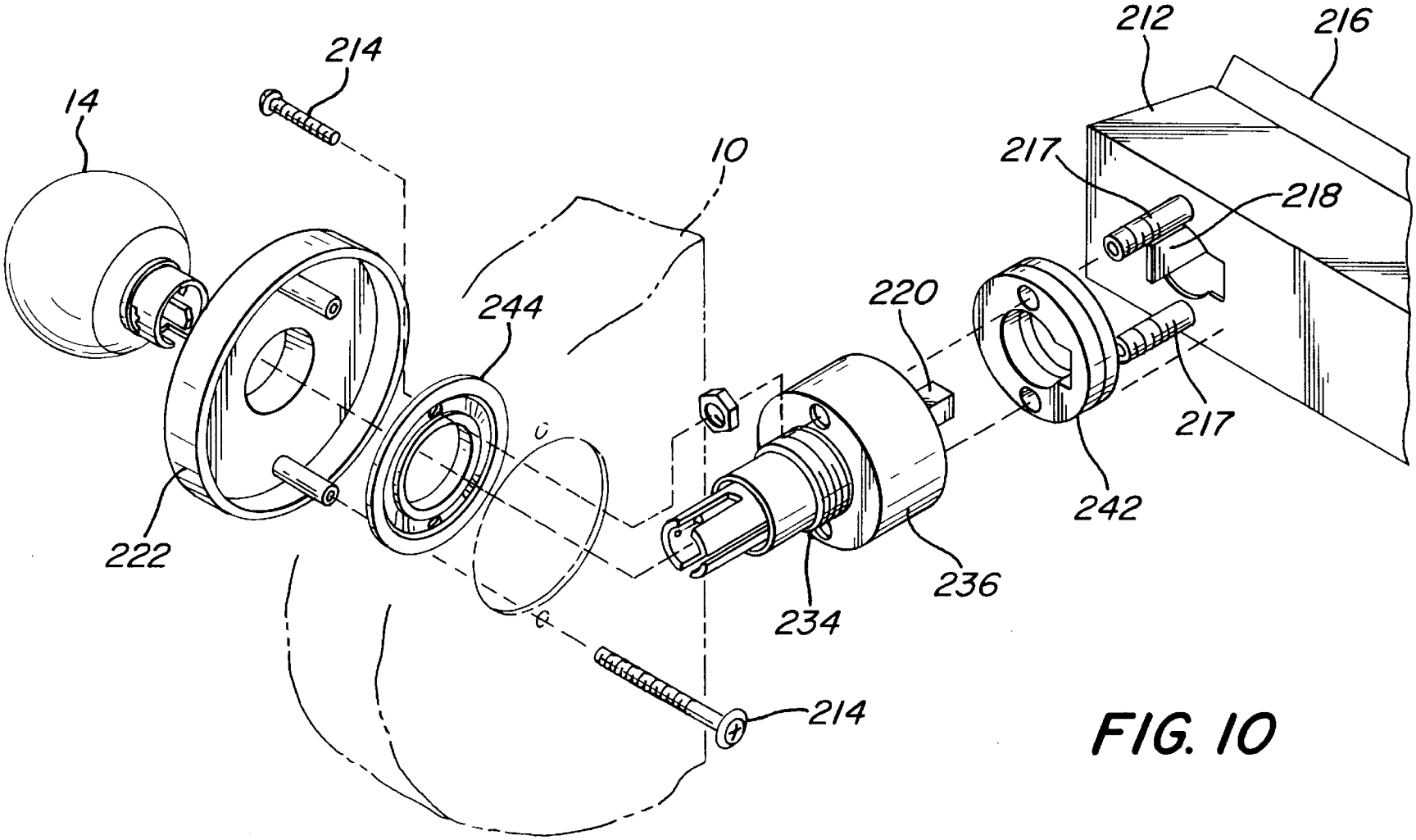

FIG. 10 illustrates the arrangement of the first embodiment components in and about the door 10. The push bar alignment member 242, the latch control assembly cover 236, and the knob control mechanism 234 are mounted on the control assembly mounting arms 217 extending from the rail assembly 212. The push bar alignment member 242, the latch control assembly cover 236, and the knob control mechanism 234 are located in the hollow portion of the door when the rail assembly is flush against the door 10. The knob alignment member 244 is located over the door cutout opposite the rail assembly 212 and is held firm by screws 214, which couple to the control assembly mounting arms 217. The finishing cover 222 is mounted over the external cutout occupied by the knob alignment member 244 and is held in place by screws 214 extending from the opposite side of the door. A portion of the knob control mechanism 234 extends beyond the surface of the door 10 through the areas provided in the knob alignment member 244 and finishing cover 222, so that the door knob 14 may be fastened thereto. Fastened to the exterior of the door opposite the finishing cover 222 is the rail assembly 212. The panic release member 218, which is rigidly connected to the panic bar 216 as described above, protrudes from a cutout in the section of the rail assembly which is flush against the exterior of the door 10. The rail assembly 212 is mounted to the door so that the cutout in the rail assembly is aligned with exterior cutout in the door. With the rail assembly so mounted, the panic release member 218 extends beyond the plane of door so that it comes in contact with the latch compression member 220 extending from the latch assembly cover 236.

Figure 12A:
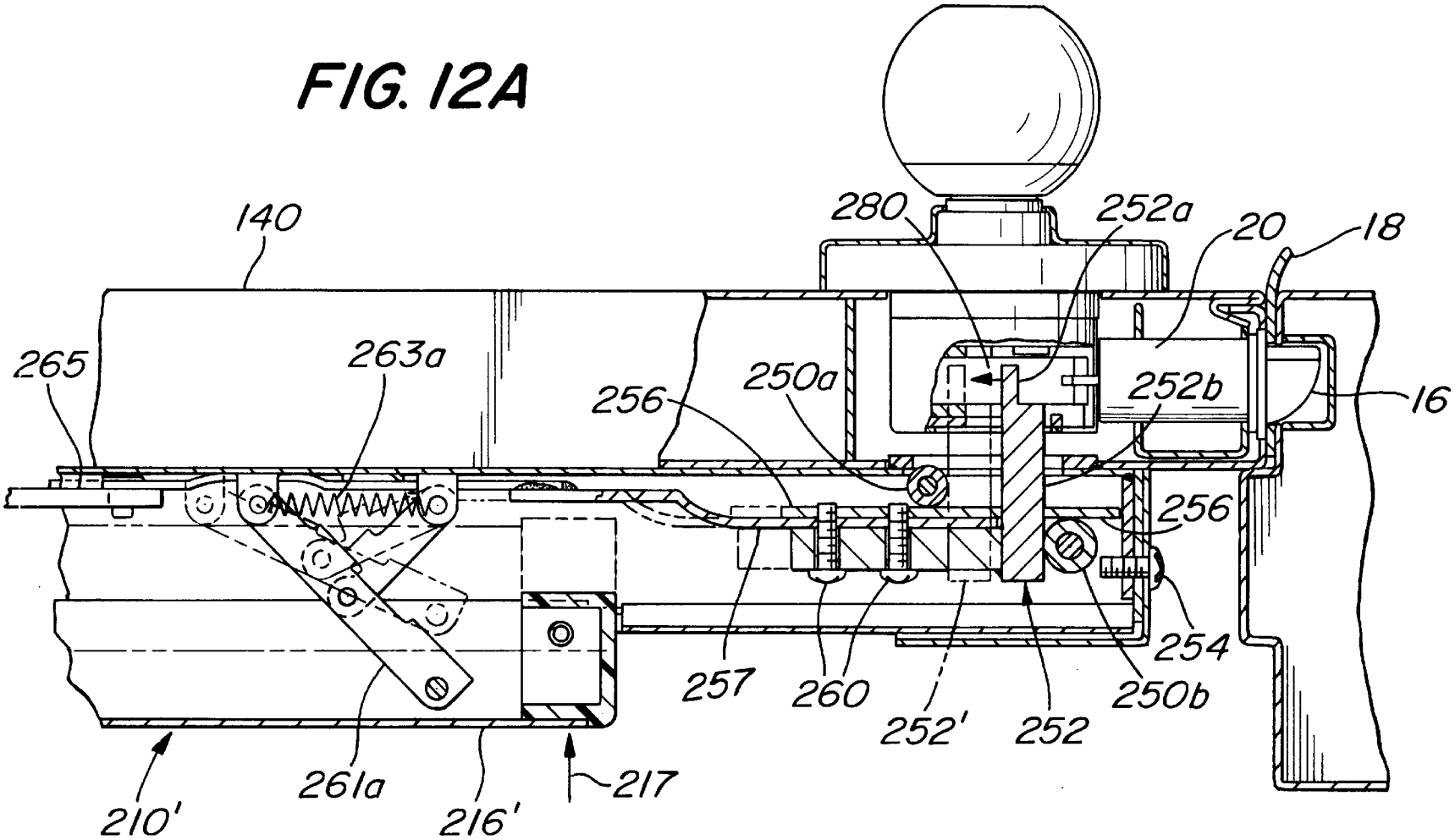
FIGS. 12A and 12B are adjacent halves of a sectional view of the door, panic device in accordance with the second embodiment, and knob.
Figure 13:
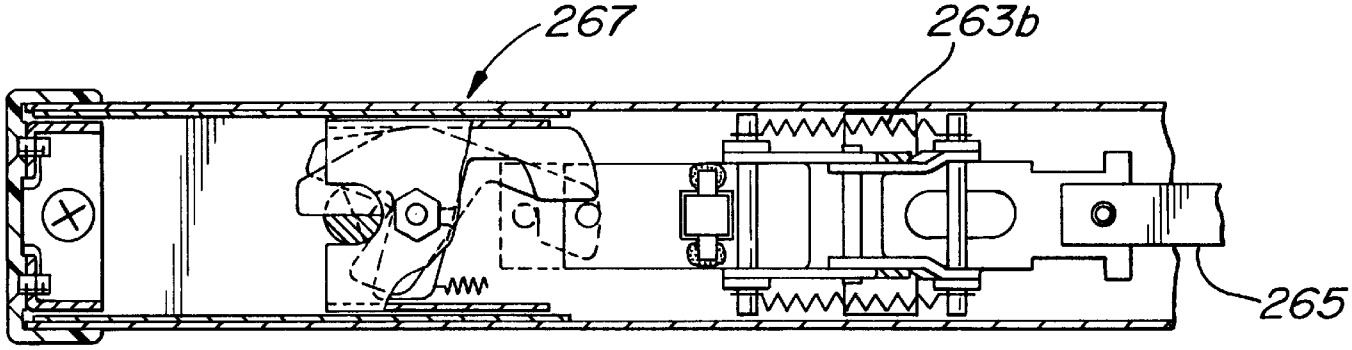
Figure 12B:
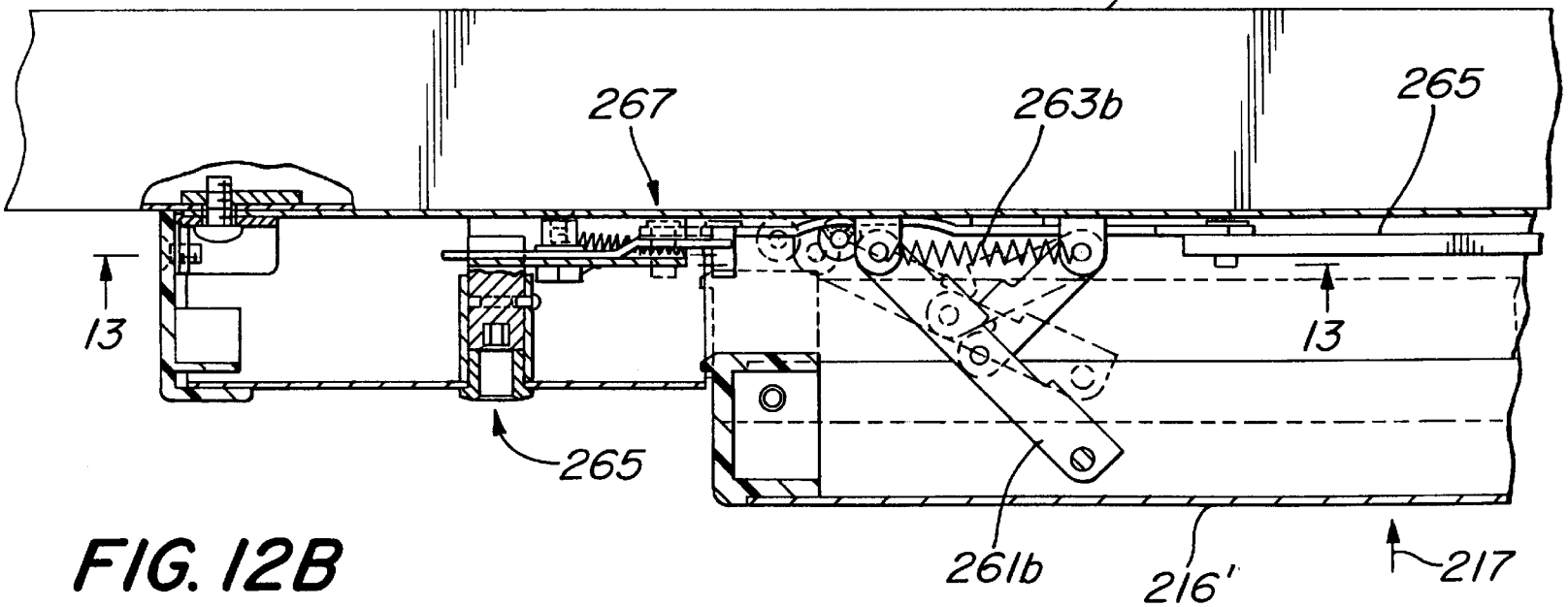

The second embodiment of the present invention is the presently preferred embodiment. As shown in FIG. 11, a panic device 210' according to the second embodiment is adapted to be mounted on a door in the same manner as the first embodiment depicted in FIG. 5. The construction and operation of the second embodiment, however, is somewhat different from the construction and operation of the first embodiment. Referring now to FIGS. 12A, 12B and 14, the second embodiment of the inventive panic device 210' includes a panic bar 216' that is movable longitudinally, i.e., in a direction normal to the door 140, in the direction arrow 217. As will be apparent from the following discussion, such movement of the panic bar 216' in the direction of arrow 217 effects the movement of a latch compression member 252 in the direction of arrow 280, to thereby cause latch bolt 16 to be withdrawn from latch bolt strike 18. A pair of rollers 250*a* and 250*b* provide support for plates 256 and 257, which are bolted to latch compression member 252. In particular, these plates are bolted to a bottom part of section 252*b* of the L-shaped latch compression member 252. A narrow section 252*a* of the latch compression member is disposed within the latch control assembly 270, and it is the narrow section 252*a* that pulls the latch bolt 16 into the latch bolt tumbler 20 (and out of the strike 18) when the panic bar 216' is pressed inward toward the door. The plates 256, 257 are held together by bolts 260. As shown in FIG. 12A, plate 257 is coupled to a first linkage lever member 261*a,* which in turn is coupled by a linkage rod 265 to a second lever member 261*b,* and the two linkage members 261*a,* 261*b* are respectively biased by springs 263*a* and 263*b*. A panic bar locking mechanism 266, 267 (depicted in FIGS. 12B and 13) permits the panic device to be locked in a position in which the latch bolt 16 remains within the tumbler 20. Such a locked position is used, e.g., when the door is expected to be frequently opened and closed and the latching operation is not necessary. Such a locking mechanism is common in prior art panic devices and therefore need not be elaborated here. Suffice it to say that a key or Allen wrench may be inserted at 266 and rotated to lock and unlock the panic bar. As shown in FIG. 14, the knob 14 is mounted on the door with a pair of screws 258, which may also be used to secure the panic device 210' to the door.

Those skilled in the art will recognize that the inventive panic device is in some respects similar to known panic devices. However, the second embodiment of the present invention differs from known devices in the latch compression member 252, which is bolted to the plates 256 and 257 as shown in FIG. 12A. In addition, the invention involves the addition of rollers 250*a* and 250*b* to provide relatively frictionless support for the plates. This permits the panic device to be operated with less force than would otherwise be required. Thus, e.g., an exemplary embodiment of the invention is able to be operated with less than 50 pounds of force. In other words, with a force of less than 50 pounds applied to the panic bar 216' in the direction of arrow 217, the latch compression member is moved from the position indicated at 252 to the position shown in dash-line form at 252'. The latch compression member is moved in the direction of arrow 280 and in turn withdraws the latch bolt 16 into the tumbler 20 to permit the door to swing open. The normal force applied to the panic bar 216' (in the direction of arrow 217) is transferred to the latch compression member 252 by the linkage members 261*a,* 261*b* and 265. The manner in which this occurs will be apparent to those skilled in the art.

Figure 15:
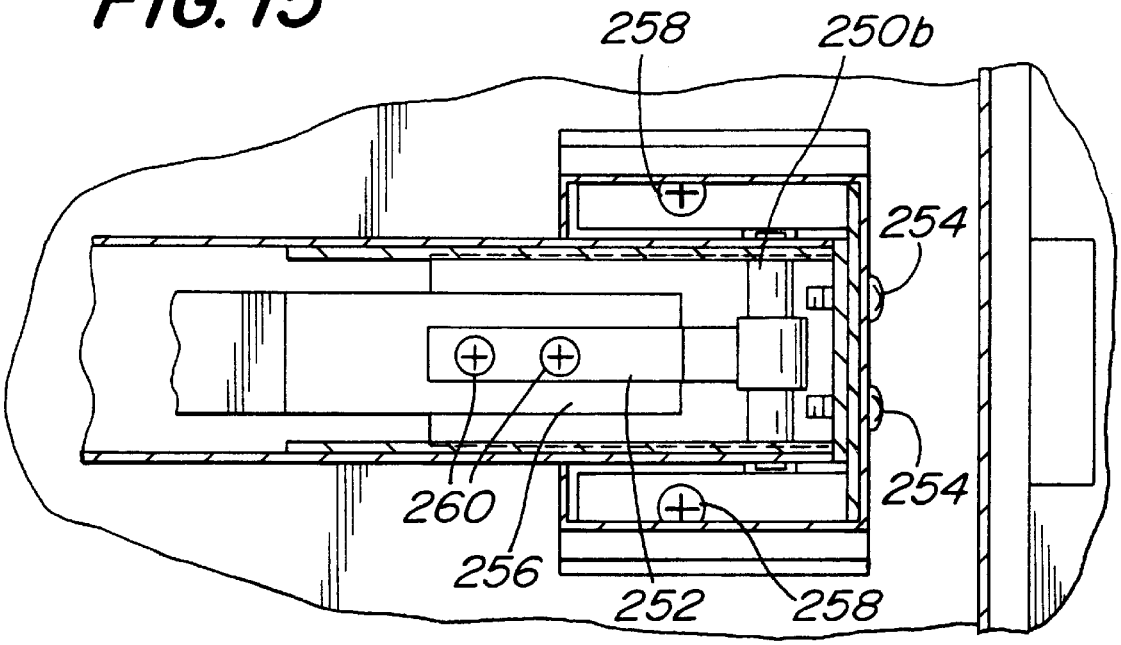
Figure 16:
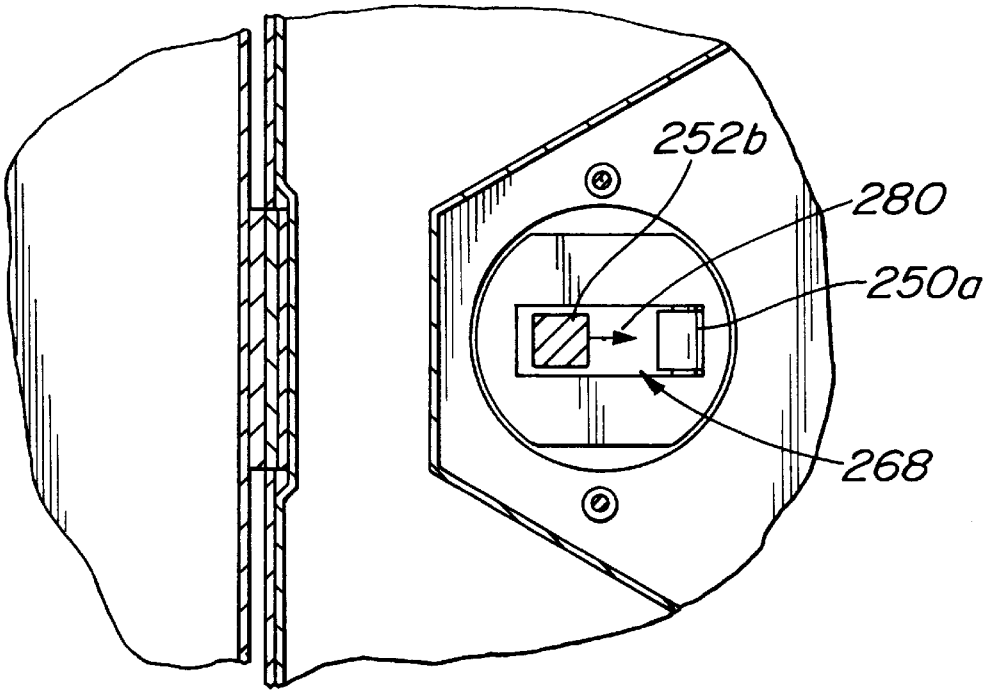

FIGS. 15 and 16 illustrate cross-sections in the planes denoted by lines 15—15 and 16—16, respectively, of FIG. 14. FIG. 15 particularly shows how the latch compression member 252 is bolted or screwed onto plate 256. FIG. 16 presents the opposite view and depicts how the latch compression member 252 (particularly the portion thereof denoted 252*b*) is free to move within space 268*a* in the direction of arrow 280 until it bears against roller 250*a*.

Figure 17:
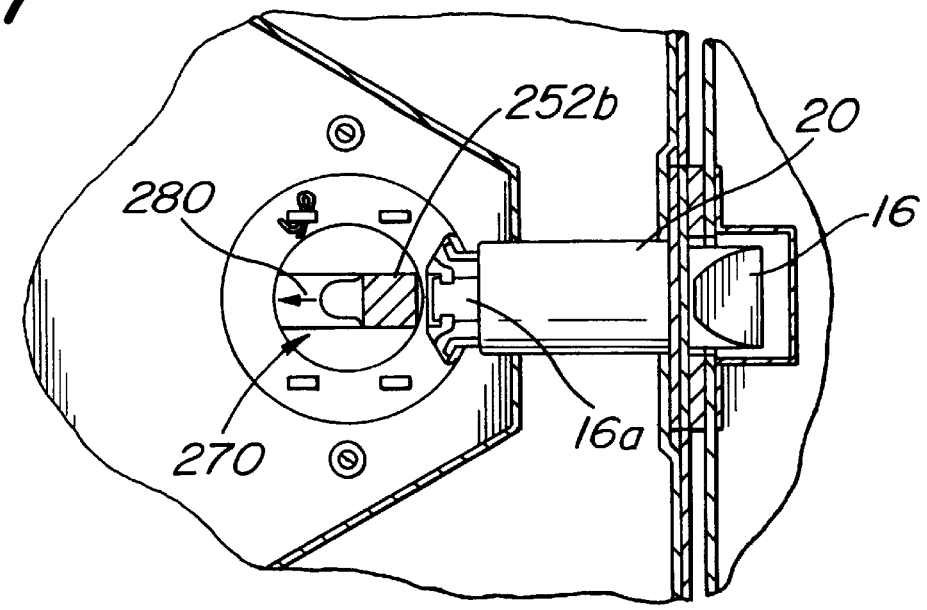
Figure 18:
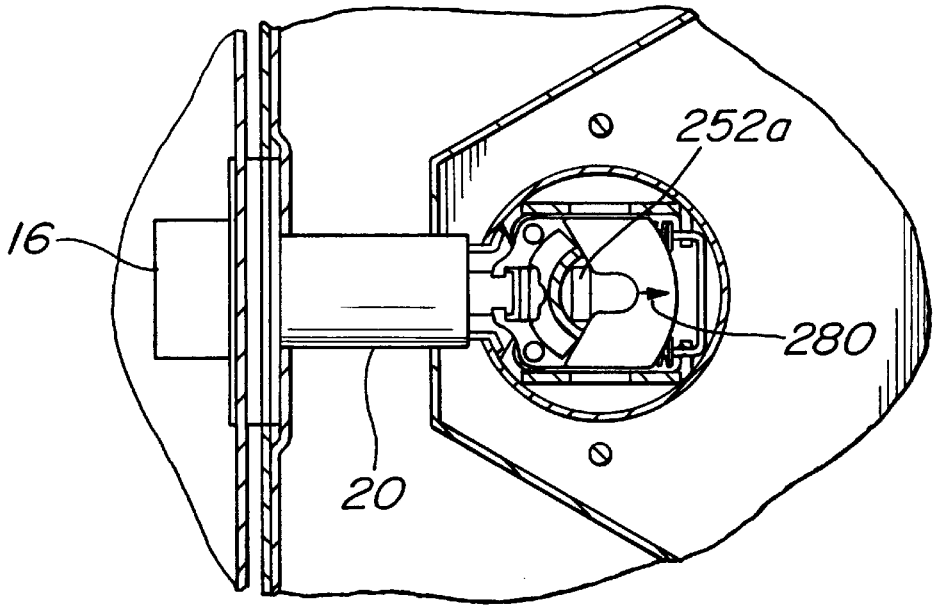

FIGS. 17 and 18 show cross-sections in the planes marked by lines 17—17 and 18—18 of FIG. 14. These views are particularly useful in that they show further details of the latch control mechanism 270. As mentioned above, such a mechanism is known to those skilled in the art and is available from numerous manufacturers, including Schlage Lock Company. As shown, the latch compression member 252, including sections 252*a* and 252*b,* fits within a bore in the latch control mechanism 270. The latch control mechanism 270 engages, or grabs, the latch bolt 16 at a grooved end 16*a* thereof, and so when the latch compression member 252 is moved in the direction of arrow 280, upon depression of the panic bar, the latch bolt 16 is withdrawn into the tumbler 20.

Figure 19:
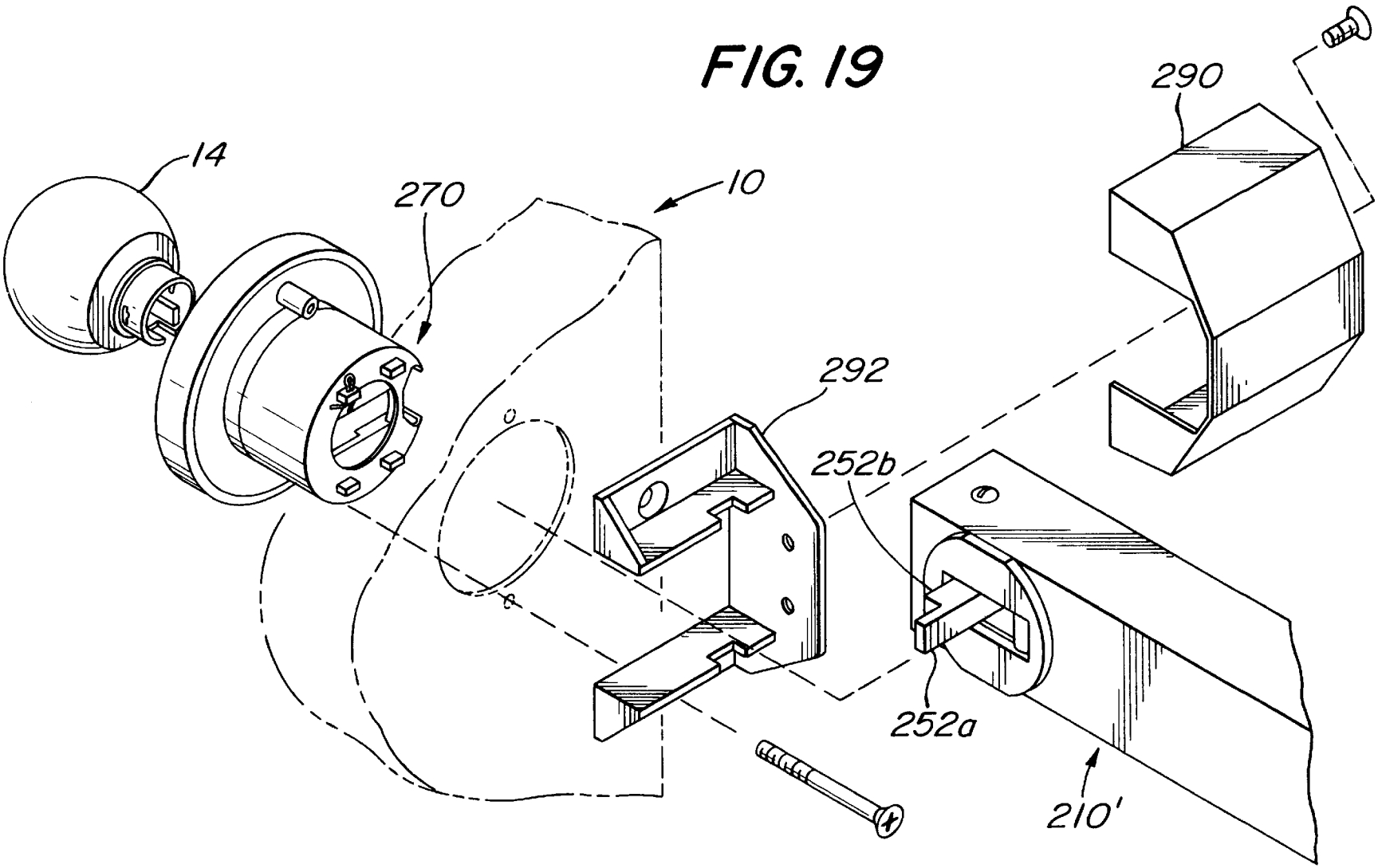

FIG. 19 is an exploded view of the second embodiment of the invention. As shown, the knob 14, latch control mechanism 270, door 10, and panic device 210' are easily assembled and secured in place with a minimal amount of additional hardware. An end plate 290 and mounting bracket 292 provide support and protection from tampering.

Prior art in the field of panic exit devices includes U.S. Pat. No. 3,490,803 (Rollins), U.S. Pat. No. 4,101,153 (Dozier), U.S. Pat. No. 3,432,631 (Deutscher), U.S. Pat. No. 4,167,280 (Godec), and U.S. Pat. No. 4,747,629 (Miller). Some comments on the manner in which the present invention may be distinguished from the prior art will now be made.

Rollins discloses a door lock construction in which a beveled plunger is used to retract a latch. This arrangement is believed to be unsuitable for use in replacing a knob or handle of an existing two-knob arrangement with a panic device, wherein the panic device is required to meet the standard of being operable with a force of less than 50 pounds.

Dozier discloses a panic device whereby an inward movement of a panic bar causes an unlatching mechanism to move in a circular motion so as to release a latch bolt. In contrast, the present invention is directed to a panic exit device that is used with a door and door jamb adapted for use with two door knobs or the like. In a standard two-knob arrangement, the latching mechanism is located in the interior of the door and operates in conjunction with a latch bolt strike similarly located in the interior of the door jamb. A major object of the present invention is to provide a panic exit device that can be used with doors that have been prepared with hollowed sections for accepting two knob latching mechanisms. Thus, the inventive panic device can quickly and easily be affixed to a standard door, making conversion from a two-knob arrangement on a door to a panic exit device a cost effective and attractive option.

Deutscher discloses a panic device of a type which the present invention improves upon. According to Deutscher, the entire latching mechanism is located outside the door and the door jamb. A door having a hollowed section for receiving a two-knob arrangement would not be suitable for use with Deutscher's device. Deutscher requires a door and door jamb that is specifically fitted for use with an externally mounted latching mechanism.

Godec discloses the mechanics of a prior art push bar assembly. Godec does not disclose a latching mechanism, nor does it disclose a panic device having a latching mechanism located internal to a door having a hollowed section for accepting a two-knob arrangement.

Miller is directed to a device that will remain locked when subject to distorting forces. Miller discloses a knob attached to an externally mounted latching mechanism. In contrast, the present provides a panic device that works with a latching mechanism mounted inside a door, and so an existing door which has been prepared for a two-knob arrangement can be saved and utilized with a panic device. Externally mounted latching devices of the kind disclosed by Miller do not achieve the benefits of the present invention.

The present invention may be employed in other specific forms without departing from the spirit or essential attributes thereof. For example, a different external turning device, such as a handle, may be used instead of a knob. Similarly, different panic bars and rail assemblies may be incorporated into the invention. Accordingly, the scope of protection of the following claims is not limited to the presently preferred embodiments disclosed above.

I claim:

1. A panic exit device for use with a door having a knob or handle mounted thereon and a latch control mechanism situated substantially inside said door and coupled to said knob, said latch control mechanism cooperating with a latch bolt that engages a strike mounted in a door jamb to latch said door in a closed position, comprising:

(a) a panic bar adapted to be mounted on said door on a side of said door opposite said knob or handle;

(b) linkage means coupled to said panic bar for biasing said panic bar away from the door; and (c) latch compression means operatively coupled to said panic bar and extending to inside said door for engaging said latch control mechanism inside said door so that upon application of a force on said panic bar to overcome the bias of said linkage means and to move said panic bar toward said door, said latch compression means moves horizontally with respect to the strike to effect a withdrawal of said latch bolt from said latch bolt strike.

2. A panic exit device as recited in claim 1, wherein said latch compression means comprises a latch compression member that is rigidly attached to said linkage means and is adapted to be coupled to said latch control mechanism, wherein an inward movement of said panic bar toward said door causes said latch compression member to move horizontally with respect to the latch strike and to withdraw said latch bolt into a latch bolt tumbler.

3. A panic exit device as recited in claim 2, further comprising roller means for supporting the movement of said latch compression means such that the latch bolt may be withdrawn into the tumbler by the application of a predetermined amount of force to the panic bar.

4. A panic exit device as recited in claim 3, wherein said predetermined amount of force is approximately 50 pounds.

5. A combination, comprising:

(a) a door having a knob or handle mounted thereon and a latch control mechanism situated substantially inside said door and coupled to said knob, said latch control mechanism cooperating with a latch bolt that engages a strike mounted in a door jamb to latch said door in a closed position;

(b) a panic bar mounted on said door on a side of said door opposite said knob or handle;

(c) linkage means coupled to said panic bar for biasing said panic bar away from the door;

(d) latch compression means operatively coupled to said panic bar and extending to inside said door for engaging said latch control mechanism so that upon application of a force to said panic bar to overcome the bias of said linkage means and to move said panic bar toward said door, said latch compression means moves horizontally to effect a withdrawal of said latch bolt from said latch bolt strike; and (e) a roller supporting the movement of said latch compression means such that the latch bolt may be withdrawn from the stride by the application of a predetermined amount of force to the panic bar.

6. A combination as recited in claim 5, wherein said latch compression means comprises a latch compression member that is rigidly attached to said linkage means and is coupled to said latch control mechanism, wherein an inward movement of said panic bar toward said door causes said latch compression member to move in a direction parallel to said door and to withdraw said latch bolt from said strike.

7. A combination as recited in claim 6, wherein said predetermined amount of force is approximately 50 pounds.

* * * * *